US007762376B2

(12) United States Patent
Kocher

(10) Patent No.: US 7,762,376 B2
(45) Date of Patent: Jul. 27, 2010

(54) ELEVATOR WITH TWO ELEVATOR CARS WHICH ARE DISPOSED ONE ABOVE THE OTHER IN A SHAFT

(75) Inventor: Hans Kocher, Udligenswil (CH)

(73) Assignee: Inventio AG, Hergiswil NW (CH)

( * ) Notice: Subject to any disclaimer, the term of this patent is extended or adjusted under 35 U.S.C. 154(b) by 85 days.

(21) Appl. No.: 11/931,852

(22) Filed: Oct. 31, 2007

(65) Prior Publication Data

US 2008/0302610 A1 Dec. 11, 2008

(30) Foreign Application Priority Data

Oct. 31, 2006 (EP) ..... 06123294

(51) Int. Cl.
*B66B 7/08* (2006.01)

(52) U.S. Cl. ..... 187/249

(58) Field of Classification Search ..... 187/249
See application file for complete search history.

(56) References Cited

U.S. PATENT DOCUMENTS

| | | | | |
|---|---|---|---|---|
| 1,837,643 | A * | 12/1931 | Anderson | 187/249 |
| 1,911,834 | A * | 5/1933 | Lindquist | 187/249 |
| 5,584,364 | A * | 12/1996 | Sakita | 187/249 |
| 5,857,545 | A * | 1/1999 | Barrett et al. | 187/249 |
| 6,062,344 | A * | 5/2000 | Okabe et al. | 187/249 |
| 6,491,136 | B2 * | 12/2002 | Kobayashi et al. | 187/254 |
| 7,097,000 | B2 * | 8/2006 | Teramoto et al. | 187/249 |
| 7,185,482 | B2 * | 3/2007 | Eichhorn | 57/230 |
| 2004/0007428 | A1 * | 1/2004 | Teramoto et al. | 187/249 |
| 2006/0070818 | A1 * | 4/2006 | Ach et al. | 187/250 |

FOREIGN PATENT DOCUMENTS

| | | | |
|---|---|---|---|
| EP | 1 006 071 | A * | 11/1999 |
| EP | 1 329 412 | A1 | 7/2003 |
| EP | 1 489 033 | | 12/2004 |
| EP | 1 564 177 | A * | 8/2005 |
| EP | 1 564 177 | A1 * | 8/2005 |
| EP | 1 700 809 | A | 9/2006 |
| JP | 3-3885 | A * | 1/1991 |
| JP | 2001-146370 | A * | 5/2001 |
| JP | 2001-310833 | A * | 11/2001 |
| JP | 2001 335259 | A | 12/2001 |
| JP | 2004-155519 | A * | 6/2004 |
| JP | 2006-36487 | A * | 2/2006 |
| WO | WO 2004/048244 | A | 6/2004 |
| WO | WO 2006/065241 | A | 6/2006 |
| WO | WO 2006/113153 | A2 | 10/2006 |

* cited by examiner

*Primary Examiner*—Thomas J. Brahan
(74) *Attorney, Agent, or Firm*—Fraser Clemens Martin & Miller LLC; William J. Clemens

(57) ABSTRACT

An elevator has at least two elevator cars, which are disposed one above the other in a shaft, which cars are vertically movable and which each have a drive, a counterweight and a traction device, wherein one drive is fixed at a first shaft wall and a second drive is fixed at an opposite second shaft wall and each drive has at least one drive pulley. At least one first deflecting roller is associated with each drive and is positioned the shaft wall that is opposite the drive and above the counterweight associated with the drive. The traction device is led from the counterweight over the deflecting roller to the drive pulley and from there to the elevator car.

19 Claims, 4 Drawing Sheets

ELEVATOR WITH TWO ELEVATOR CARS WHICH ARE DISPOSED ONE ABOVE THE OTHER IN A SHAFT

FIELD OF THE INVENTION

The invention relates to an elevator with at least two elevator cars which are disposed one above the other and are vertically movable in a shaft.

BACKGROUND OF THE INVENTION

An elevator consists of at least one elevator car which is vertically movable in a shaft and receives passengers in order to move these to a desired floor of a building. In order to be able to exercise this task the elevator usually has at least one of the following elevator components: a drive, deflecting rollers, traction elements, a counterweight and a respective pair of rails for guidance of an elevator car and a counterweight.

In that case the drive produces the power required for transport of the passengers present in the elevator car. An electric motor usually looks after this function. This directly or indirectly drives a drive pulley disposed in friction contact with a traction element. The traction element can be a belt or a cable. It serves for suspending as well as conveying an elevator car and a counterweight, which are both suspended in such a manner that the gravitational forces thereof act in opposite direction along the traction element. The resulting gravitational force which has to be overcome by the drive correspondingly substantially reduces. In addition, due to the greater contact force of the traction element with the drive pulley a greater drive moment can be transmitted from the drive pulley to the traction element. The traction element is guided by deflecting rollers.

Optimum utilization of the shaft volume has ever increasing significance in elevator construction. Particularly in high-rise buildings with a high degree of utilization of the building the most efficient possible management of the passenger traffic for a given shaft volume is to be sought. This objective can be achieved firstly by an optimum space-saving arrangement of the elevator components, which creates room for larger elevator cars, and secondly by elevator concepts which enable vertical movement of several independent elevator cars in one shaft.

An elevator with at least two elevator cars disposed one above the other in the same shaft is known from EP 1 489 033. Each elevator car has an own drive and an own counterweight. The drives are arranged near first and second shaft walls and the counterweights are also suspended near first or second shaft walls in each instance below the associated drive at driving or holding cables. The axes of the drive pulleys of the drives are perpendicular to first and second shaft walls. The two independently movable elevator cars guarantee a high transport performance. The positioning of the drives in the shaft near first or second walls makes a separate engine room redundant and enables a space-saving compact arrangement of the drive elements in the shaft head.

SUMMARY OF THE INVENTION

An object of the present invention is to further improve the arrangement of elevator components for the vertical movement of several elevator cars in an elevator shaft.

The elevator according to the present invention has at least two elevator cars, which are disposed one above the other, in a shaft, which cars are vertically movable and each have an own drive, an own counterweight and an own traction means, wherein these drives are fixed in the region of the shaft head in such a manner that one drive is fixed to a first shaft wall and a further drive is fixed to an opposite second shaft wall and each has at least one drive pulley. At least one first deflecting pulley is associated with one drive and is positioned on a second or first shaft wall, which is opposite this drive, above the counterweight associated with this drive. The traction means is led from the counterweight over the deflecting roller to the drive pulley and from there to the elevator car. Advantageously a first deflecting roller is associated with each of the two drives.

An advantage of the elevator according to the present invention resides in the space-saving arrangement of the drives in the shaft head near first and second shaft walls. In addition, the traction means is, in the change of the sides in the shaft head above the elevator car, led in space-saving manner from the first shaft side to the second shaft side between drive and first deflecting roller in an otherwise unutilized space. Finally, the counterweight can be suspended in simple manner below the first deflecting roller.

Advantageously, a traction means is so guided by the drive pulley and the first deflecting roller above the elevator car that the traction means forms an acute angle with third and fourth shaft walls. This angle is as a rule not greater than 20°. Advantageously, the elevator car is guided by car guide rails and the counterweight is positionable between car guide rails and third and fourth shaft walls.

The advantage of this embodiment of the present invention resides in the space-saving arrangement of the counterweights in the shaft between the car guide rails and third and fourth shaft walls.

Advantageously at least one elevator car is suspended in a block-and-tackle configuration. The elevator car is in that case suspended in a block-and-tackle configuration at second and third deflecting rollers. The traction means is led between the drive pulley and a first fixing point via second and third deflecting rollers. The elevator car is usually suspended in an upper or a lower block-and-tackle configuration. The traction means is, for example, led in a lower block-and-tackle configuration from the drive pulley laterally of the elevator car downwardly to the second deflecting roller. From the second deflecting roller the traction means is then led below the elevator car through to the third deflecting roller and from there further laterally of the elevator car upwardly to a first fixing point of the traction means. The arrangement of the second and third deflecting rollers is carried out analogously in the case of an upper block-and-tackle suspension configuration with corresponding guidance of the traction means. The traction means is led from the drive pulley along first or second shaft walls to the second deflecting roller. From there the traction means is led above the elevator car to the third deflecting roller and finally along second or first shaft walls to the first fixing point.

The advantage of this embodiment of the present invention is that thanks to the suspension of the elevator car in a block-and-tackle configuration smaller traction moments are sufficient for operation of the elevator and correspondingly smaller and more economical drives are usable. If further advantage resides in the space-saving change of side of the traction means between first and second shaft walls from the drive pulley to the first fixing point via a second and third deflecting roller in an otherwise unutilized space laterally of and below the elevator car.

Advantageously the elevator has fourth deflecting rollers at which the counterweight is suspended in a block-and-tackle configuration. The traction means is in that case led from the first deflecting roller downwardly to the fourth deflecting roller and from there back up to a second fixing point of the traction means.

The advantage of this embodiment of the present invention is that thanks to the suspension of the counterweight in a block-and-tackle configuration smaller traction moments are sufficient for operation of the elevator and correspondingly smaller and more economical drives are usable.

Advantageously the fixing points associated with a traction means lie on the same side of the associated elevator car.

The advantage of this embodiment of the present invention resides in the simpler mounting of the fixing points of the traction means. Already just the physical proximity of the two fixing points of the traction means facilitates mounting of the same for the engineer. In addition, thanks to the integration of the two fixing points in one component the number of individual parts of the elevator can be reduced.

Advantageously the traction means is a belt, which is guided by the drive pulley and at least first, second, third and fourth deflecting rollers and is disposed in contact with the drive pulley and deflecting rollers at only one side of the belt, and the belt is guided between the drive pulley, the deflecting rollers and its fixing points to be substantially free of twisting.

The advantage of this embodiment is the simple use of belts with a surface structured at one side, such as ribs, teeth or wedges. Since the guidance of the traction means takes place substantially free of twisting, guidance of the belt in the same sense by the drive pulley and the deflecting rollers is possible. Engagement of the structuring at one side in the drive pulleys and the deflecting rollers is thereby possible without twisting of the belt about its longitudinal axis. The belt has two dimensions transversely to the traction direction, i.e. a first dimension with a relatively wide extent and a second dimension with a relatively narrow extent. This means that the belt occupies substantially more space in the elevator shaft transversely to its traction direction in its first dimension than in its second dimension. In the case of twist-free guidance of the belt in the same sense the belt occupies minimum space in the shaft area, since the first wide dimension of the belt is parallel to first or second shaft walls and only the short second dimension is disposed in the shaft area perpendicularly to the first or second shaft walls. For that reason this arrangement of the elevator with a twist-free guidance of the belt is particularly space-saving. Moreover, the belts, with a substantially twist-free guidance, are exposed to lower friction forces and transverse forces and have a longer service life. The elevator is thereby also more maintenance-friendly.

Advantageously the drives are disposed in the region of the shaft head. In that case the drives are fastened at different levels so that the guidance of the traction means above the elevator car between a drive pulley and an associated first deflecting roller takes place free of conflict. A first drive and its associated first deflecting roller are then fastened at a first level and a second drive and its associated first deflecting roller at a second level disposed above or below the first level. Correspondingly, the traction means of a first and second elevator car are guided at two different levels.

The advantage of this embodiment of the present invention resides in the space-saving arrangement of the drives and associated first deflecting rollers. Moreover, a conflict-free, i.e. contact-free, guidance of the traction means above the elevator car is guaranteed.

Advantageously the drives are disposed in the region of the shaft head, wherein the drives are fastened at the same level.

The advantage of this embodiment of the present invention resides in the space-saving arrangement of the drives and associated first deflecting rollers adjacent to one another in the shaft head, whereby a minimum amount of shaft head height is obstructed. Moreover, a conflict-free, i.e. contact-free, guidance of the traction means above the elevator car is guaranteed.

Advantageously, first and second drives are fixed on a common beam. Alternatively, each of the drives is fixed on a respective beam.

The advantage of this embodiment of the present invention resides in the simple, flexible and space-saving arrangement of the drives in the shaft head.

Advantageously the elevator has shaft doors and car doors, wherein the shaft doors consist of two sliding elements and the car doors of more than two sliding elements.

The advantage of this embodiment of the present invention is that sufficient space is created in order to position the counterweight of an elevator car in the vicinity of first or second shaft walls between the guide rails of the elevator car and third or fourth shaft walls.

The co-operation of the above-described elements of the present invention, the positioning of the at least two drives, the deflecting rollers and the counterweights and the substantially twist-free guidance of the traction means resulting therefrom, particularly in the case of belts, gives a compact space-saving and nevertheless very flexible arrangement of the elevator components in the elevator shaft.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 2:
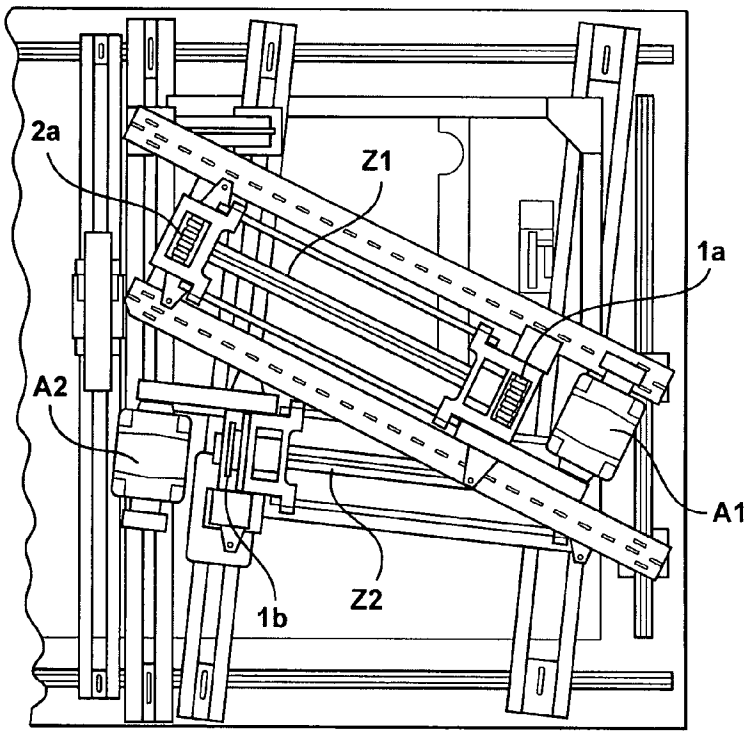
FIG. 2 is a plan view of the elevator installation shown in FIG. 1.
Figure 1:
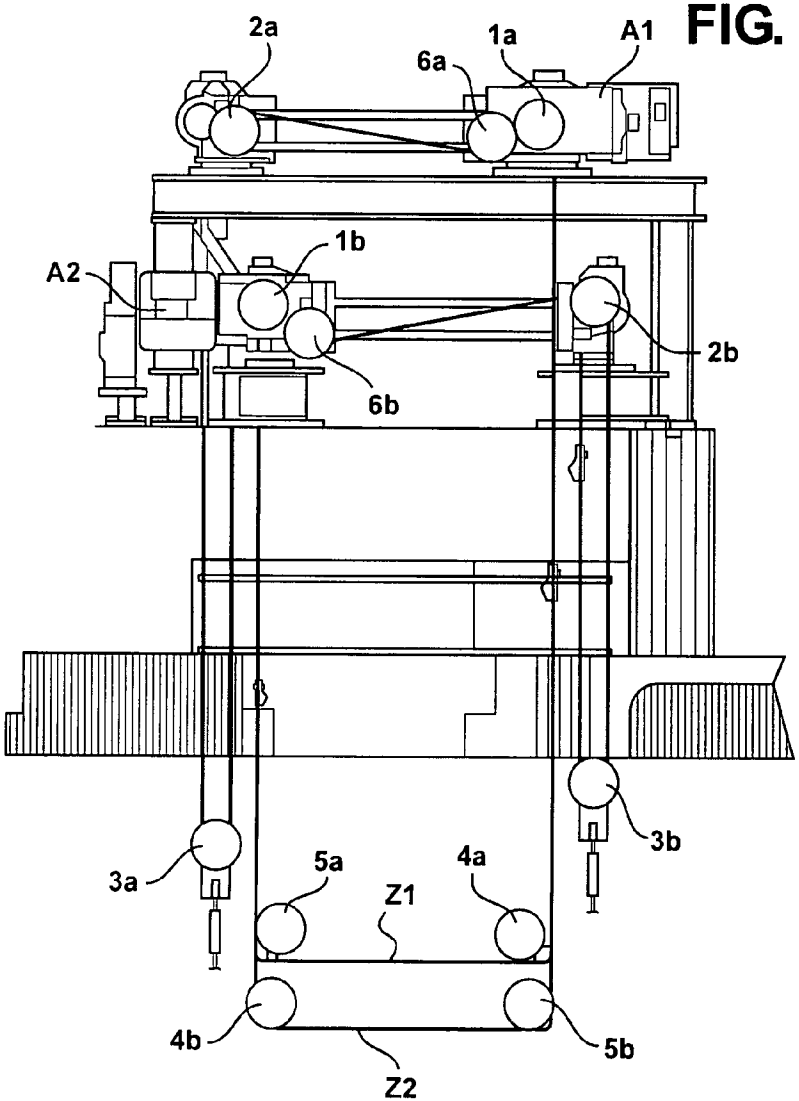
FIG. 1 is an elevation view of an elevator installation according to the present invention with two elevator cars, two drives, two drive pulleys, two traction means and several deflecting rollers.

FIGS. 1 and 2 show an elevator for at least two elevator cars which each have an own drive A1, A2 and are movable independently of one another in a vertical direction. The drives A1, A2 are positioned in the shaft head above the elevator cars in the vicinity of first and second side walls S1, S2 (FIG. 3) of the elevator shaft S. The first and second shaft side walls are those mutually opposite shaft walls not having shaft doors. In that case the drives A1, A2 are disposed at two different levels so that two traction means Z1, Z2, at which the elevator cars are suspended, are free of conflict and can be guided without mutual contact.

Figure 4:
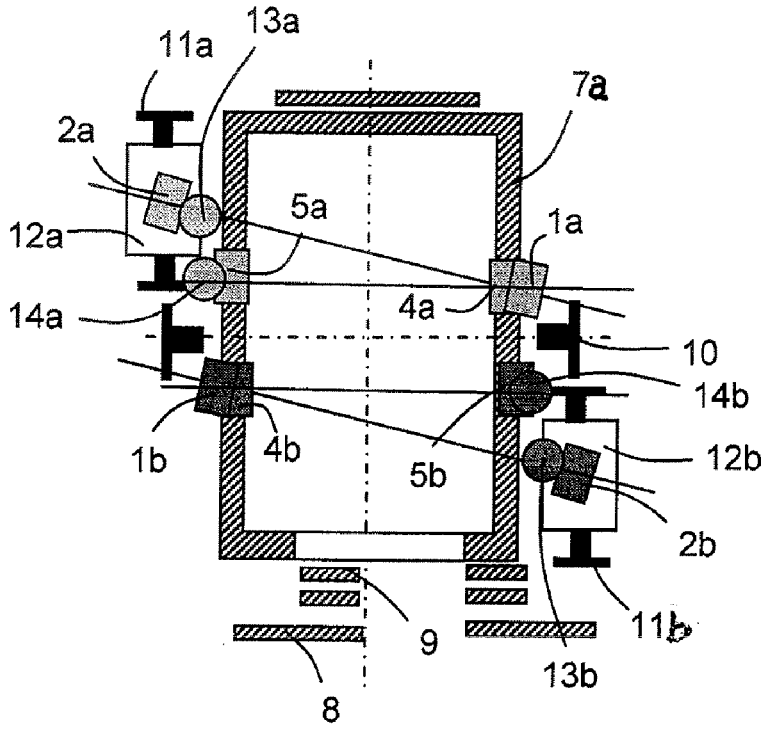
FIG. 4 is a schematic plan view of an another embodiment according to the present invention of an elevator with two elevator cars, two drives, which are positioned each in front of and behind the car guide rails, two drive pulleys, two traction means, several deflecting rollers, two counterweights, two counterweight guide rails, a four-part car door and a door at the shaft side.

With knowledge of the present invention numerous possibilities of fixing the drives A1, A2 in the shaft are open to the expert. The expert can also arrange the two drives A1, A2 at the same level. This variant is not shown purely for reasons of space, since a side view of the drives A1, A2, which then lie one behind the other, has restricted significance. However, the plan view of FIG. 4 shows an arrangement of the drives A1, A2 which enables not only the already mentioned fixing of the drives A1, A2 at different levels, but also a fixing of the drives at the same level. This arrangement is primarily of advantage when the space conditions in the shaft head are particularly tight. Moreover, a conflict-free guidance of the traction means Z1, Z2 is also guaranteed in this variant.

Advantageously the drives A1, A2 are each mounted on a respective beam, whereby substantial freedoms in the orientation of the drives A1, A2 are given. In a further advantageous variant the drives A1, A2 are mounted at the same beam, namely an upper drive A1 on the upper side of the beam and a lower drive A2 on the lower side of the beam. This arrangement of the drives A1, A2 is very compact and has the advantage of obstructing as little space as possible in the shaft head.

The drive A1, A2 forms, together with a drive pulley 1*a*, 1*b* for driving the traction means Z1, Z2, a drive module. The drive pulley 1*a*, 1*b* is so designed that it is suitable for receiving single or several traction means Z1, Z2. The traction means Z1, Z2 are preferably belts such as wedge-ribbed belts with ribs, which engage in one or more depressions at the drive pulley side, at one side. Belt variants such as smooth belts and belts toothed at one side or both sides, with corresponding drive pulleys 1*a*, 1*b* equally usable. In addition, different kinds of cables, such as single cables, double cables or multiple cables, are usable. The traction means have strands of steel wire or aramide fibers.

The traction means Z1, Z2 is configured in FIG. 1 as a block-and-tackle, wherein not only at least one elevator car, but also at least one counterweight are suspended in a block-and-tackle configuration. The traction means Z1, Z2 is so led from a first fixing point 13*a*, 13*b* to a second fixing point 14*a*, 14*b* that it is guided in substantially twist-free manner by several deflecting rollers 2*a*, 2*b*, 3*a*, 3*b*, 4*a*, 4*b*, 5*a*, 5*b* as well as the drive pulley 1*a*, 1*b* as shown in FIGS. 3 to 8.

The traction means Z1, Z2 is in that case so led from the first fixing point 13*a*, 13*b* to the deflecting roller 2*a*, 2*b* that the respective counterweight associated with each elevator car is suspended at the deflecting roller 3*a*, 3*b* in a block-and-tackle configuration. The traction means Z1, Z2 thus extends from the first fixing point 13*a*, 13*b* along a first or second shaft side wall S1, S2 downwardly to the deflecting roller 3*a*, 3*b*, loops around this from inside to outside at an angle of approximately 180° and leads further along a first or second shaft side wall upwardly to the deflecting roller 2*a*, 2*b*. This deflecting roller 2*a*, 2*b* lies opposite the associated drive pulley 1*a*, 1*b* in the vicinity of second or first shaft walls. In the present form of embodiment the deflecting roller 2*a*, 2*b* is a component of a deflecting module which is connected with the drive module by way of rigid bar-shaped rods and forms a subassembly therewith. The advantage of this form of embodiment resides in the reduction in the number of components and the simple assembly connected therewith. In addition, the driving and deflecting modules can be displaced longitudinally of the connecting rods so that a flexible length adaptation of the subassembly to the actual dimensions of the shaft is possible. A further advantage resides in the modular construction of the subassembly, which permits favorable maintenance or replacement thereof.

From the deflecting roller 2*a*, 2*b* the traction means Z1, Z2 is now led to the drive pulley 1*a*, 1*b* along the shaft roof and loops around this drive pulley 1*a*, 1*b* from the inside to the outside in a looping angle of 90 to 180°. In the further course, the traction means Z1, Z2 produces below the drive pulley 1*a*, 1*b*, together with the deflecting roller 4*a*, 4*b* and the deflecting roller 5*a*, 5*b*, a block-and-tackle suspension of the elevator car in that the traction means Z1, Z2 is led from the drive pulley 1*a*, 1*b* along first or second shaft side walls downwardly to the deflecting roller 4*a*, 4*b*. The traction means Z1, Z2 loops around the deflecting roller 4*a*, 4*b* from the outside to the inside at a looping angle of approximately 90° and thereafter leads horizontally to the deflecting roller 5*a*, 5*b*. Finally, the traction means Z1, Z2 after looping around the deflecting roller 5*a*, 5*b* from inside to outside at a looping angle of approximately 90° passes upwardly along first or second shaft walls to the second affixing point 14*a*, 14*b*.

An adjusting pulley 6*a*, 6*b* is an optional component of the drive module. With this adjusting pulley 6*a*, 6*b* the looping angle of the traction means at the drive pulley 1*a*, 1*b* can be adjusted or increased or reduced in order to transmit the desired traction forces from the drive pulley 1*a*, 1*b* to the traction means Z1, Z2.

Figure 3:
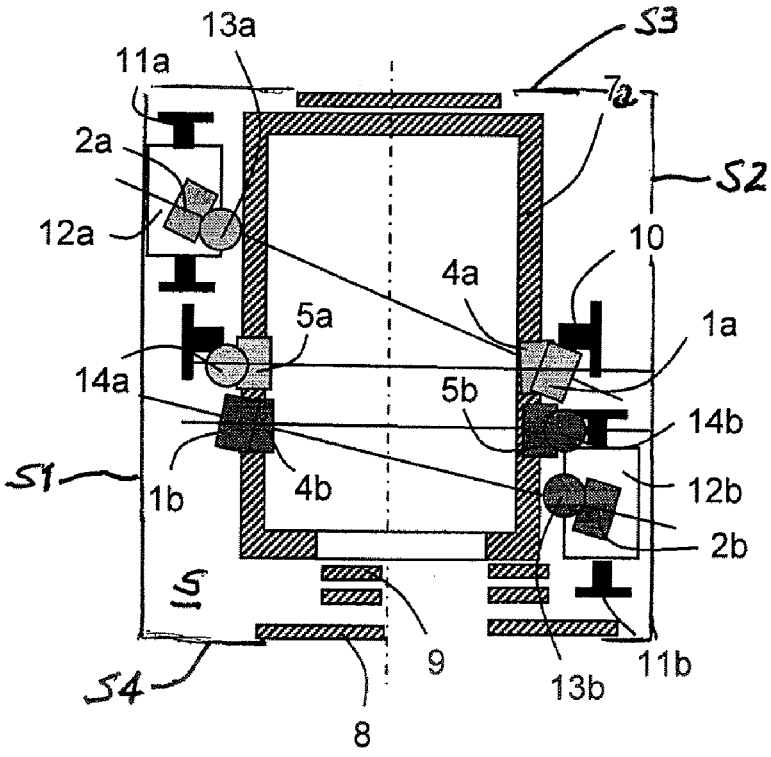
FIG. 3 is a schematic plan view of an embodiment according to the present invention of an elevator with two elevator cars, two drives, which are positioned in front of the car guide rails, two drive pulleys, two traction means, several deflecting rollers, two counterweights, two counterweight guide rails, a four-part car door and a door at the shaft side.

It is apparent from FIGS. 2 to 4 that the two axes, formed from the drives A1, A2 and the deflecting rollers 2*a*, 2*b*, are disposed at an acute angle to third and fourth shaft side walls S3, S4 of the shaft S. The third and fourth shaft side walls are those mutually opposite walls in the shaft which have at least one shaft door 8 facing a car door 9. It is thus achieved that the associated counterweights 12*a*, 12*b*, which are suspended at the first fixing point 13*a*, 13*b* and the deflecting roller 2*a*, 2*b* in a block-and-tackle configuration, are positioned between the car guide rails 10 of the elevator cars 7*a*, 7*b* as well as the third and fourth shaft side walls. The advantage of such an arrangement of the drive A1, A2 and the deflecting roller 2*a*, 2*b* resides in the space-saving and simple positioning of the counterweights 12*a*, 12*b*. The counterweights 12*a*, 12*b* are in that case guided by counterweight guide rails 11*a*, 11*b*.

Moreover, the axis, formed by the two deflecting rollers 5*a*, 5*b* and 4*a*, 4*b*, at which the elevator car 7*a*, 7*b* is suspended lies near the car guide rails 10. Moments which are transmitted by the suspension forces from the traction means Z1, Z2 via the elevator cars 7*a*, 7*b* to the car guide rails 10 are thereby kept small.

FIGS. 3 and 4 show two variants of the previously described form of embodiment of the present invention. In that case the suspension axes, formed from the deflecting rollers 4*a*, 4*b* and 5*a*, 5*b*, at which the elevator cars 7*a*, 7*b* are suspended lie either both in front of the car guide rails 10 or one in front of and one behind the car guide rails 10. The expert may, depending on the respective space conditions in the shaft, prefer one or other solution, wherein the first-mentioned symmetrical suspension is advantageous with respect to the moment exerted by the elevator cars 7*a*, 7*b* on the car guide rails 10. The spacing from the suspension axis of the elevator cars 7*a*, 7*b* from the car guide rails 10 is kept to a minimum and thus reduces the moment, while in addition the two mutually oppositely acting moments are partly or entirely cancelled. With knowledge of the above teaching further variants (not shown) are available such as, for example, the position of the two suspension axes behind the car guide rails.

The spacing-saving positioning of at least one counterweight 12*a*, 12*b* between the car guide rails 10 and a third or fourth shaft wall can be realized thanks to a special arrangement of the car door 9. In normal operation of the elevator the elevator cars 7*a*, 7*b* are, at a floor stop, flush with the floor and the car doors 9 are opened together with the shaft doors 8 so as to enable transfer of passengers from the floor to the elevator cars 7*a*, 7*b*. On opening of the car doors 9 the sliding elements thereof protrude into the shaft space and occupy to a certain extent an otherwise unusable shaft space. If the car door 9 does not consist, as usual, of two sliding elements, but of at least four sliding elements which are telescopically retractable and extensible, less shaft space is occupied during the opening process of the car doors 9. Thanks to the shorter sliding elements these sliding elements project, when the car door 9 is open, less far into the shaft room and thus keep more space free for the counterweights 12*a*, 12*b* or other objects in the shaft, such as electric installations, sensors, safety equipment or terminal boxes.

The expert has available, in accordance with the present invention, various possibilities for suspending the elevator cars 7*a*, 7*b*. A suspension variant is optimum depending on the respective space availability in the shaft head, shaft pit or between floors.

Figure 5:
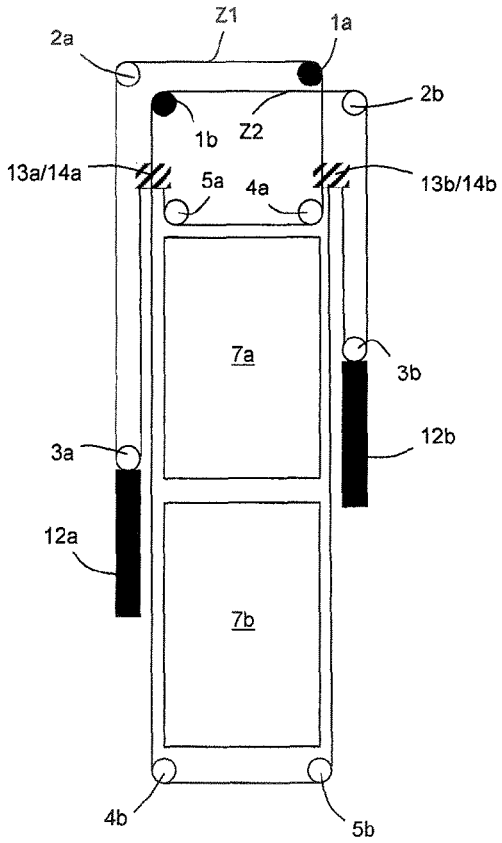
FIG. 5 is a schematic side view of an embodiment according to the present invention of an elevator with two elevator cars, which are each suspended as a lower block-and-tackle or an upper block-and-tackle, two drives, two drive pulleys, two traction means, several deflecting rollers, two counterweights and two counterweight guide rails.
Figure 6:
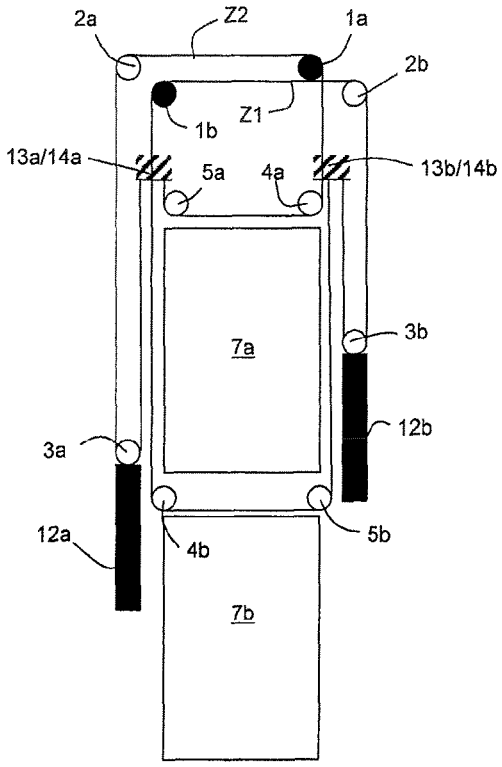
FIG. 6 is a schematic side view of an embodiment according to the present invention of an elevator with two elevator cars, which are each suspended as an upper block-and-tackle, two drives, two drive pulleys, two traction means, several deflecting rollers, two counterweights and two counterweight guide rails.

FIGS. 5 and 6 show an arrangement with two elevator cars 7*a*, 7*b* suspended in a block-and-tackle configuration. In FIG. 5 the upper elevator car 7*a* is suspended as upper block-and-tackle and elevator car 7*b* as lower block-and-tackle. This suspension variant is primarily advantageous when a minimum approach between the elevator cars is desired, if, for example, the floor spacings are small. According to FIG. 6 the two elevator cars 7*a*, 7*b* are suspended as upper block-and-tackles. This variant is of advantage when the space conditions in the shaft pit are tight. In addition, in both examples the upper elevator car 7*a* with upper block-and-tackle cannot be forced by the traction means Z1, Z2 into the shaft head.

Figure 7:
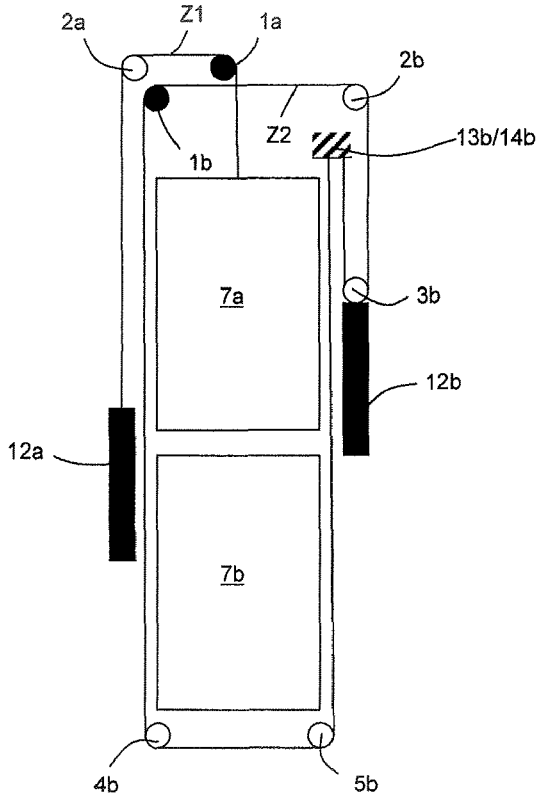
FIG. 7 is a schematic side view of an embodiment according to the present invention of an elevator with two elevator cars, which are suspended at the top 1:1 and at the bottom as a lower block-and-tackle, two drives, two drive pulleys, two traction means, several deflecting rollers, two counterweights and two counterweight guide rails.
Figure 8:
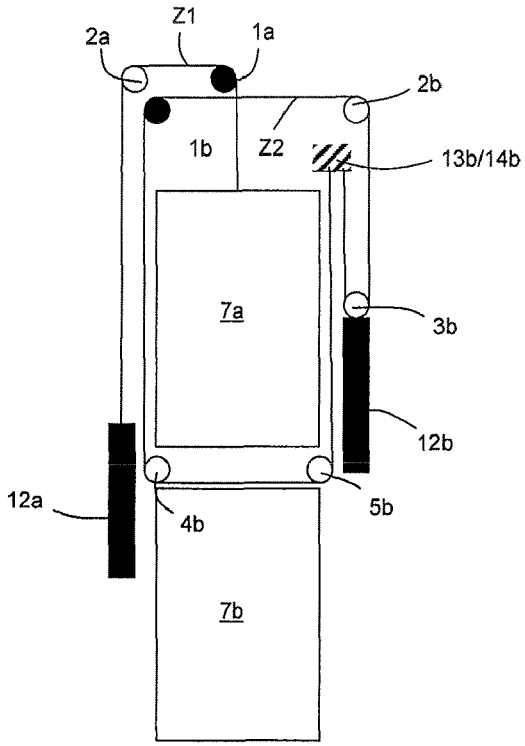
FIG. 8 is a schematic side view of an embodiment according to the present invention of an elevator with two elevator cars, which are suspended at the top 1:1 and at the bottom as a lower block-and-tackle, two drives, two drive pulleys, two traction means, several deflecting rollers, two counterweights and two counterweight guide rails.

FIGS. 7 and 8 show a suspension with a 1:1 suspension of the upper elevator car 7*a*. The lower elevator car 7*b* is, according to the present invention, suspended in a block-and-tackle configuration. Depending on the respective space conditions in the elevator shaft the lower elevator car 7*b* can be suspended as an upper block-and-tackle or a lower block-and-tackle.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator with at least two elevator cars which are disposed one above the other in an elevator shaft having a first shaft sidewall and a second shaft sidewall disposed opposite one another in the elevator shaft, which cars are vertically movable, comprising:

a first elevator car of the at least two elevator cars connected to a first counterweight by a first traction means;

a first drive fixed in a region of a head of the elevator shaft at the first shaft side wall and having a first drive pulley for driving said first traction means;

a second elevator car of the at least two elevator cars connected to a second counterweight by a second traction means;

a second drive fixed in the region of the head of the elevator shaft at the second shaft side wall having a second drive pulley for driving said second traction means, said first counterweight being positioned adjacent the second shaft side wall and said second counterweight being positioned adjacent the first shaft side wall, said first counterweight and the second counterweight being positioned in the same elevator shaft; and a first deflecting roller associated with said first drive and being positioned at the second shaft side wall above said first counterweight whereby said first traction means is led from said first counterweight over said first deflecting roller to said first drive pulley and from there directly to said first elevator car.

2. The elevator according to claim 1 including a second deflecting roller associated with said second drive and being positioned at the first shaft side wall above said second counterweight whereby said second traction means is led from said second counterweight over said second deflecting roller to said second drive pulley and from there to said second elevator car.

3. The elevator according to claim 1 wherein said first traction means is guided by said first drive pulley and said first deflecting roller above said first elevator car whereby said first traction means forms an acute angle with third and fourth shaft side walls of the elevator shaft.

4. The elevator according to claim 3 wherein said angle is at most 20°.

5. The elevator according to claim 1 wherein said first and second elevator cars are each guided by car guide rails and said first and second counterweights are each positioned between an adjacent one of said car guide rails and an adjacent different one of third and fourth shaft side walls of the elevator shaft.

6. The elevator according to claim 1 wherein at least one of said first and second elevator cars is suspended in a block-and-tackle configuration.

7. The elevator according to claim 6 including another first deflecting roller associated with said second drive and being positioned at the first shaft side wall above said second counterweight whereby said second traction means is led from said second counterweight over said another first deflecting roller to said second drive pulley and from there to said second elevator car and wherein each of said first and second elevator cars is suspended in a block-and-tackle manner at associated second deflecting rollers and third deflecting rollers, and said first and second traction means are each led between said first and second drive pulley respectively and a first fixing point via said associated second deflecting rollers and said associated third deflecting rollers.

8. The elevator according to claim 7 wherein each said first and second counterweights is suspended in a block-and-tackle manner at associated fourth deflecting rollers, wherein said first and second traction means are each led from said associated first deflecting rollers downwardly to said fourth deflecting rollers and from there back up to a second fixing point.

9. The elevator according to claim 1 wherein said first and second traction means are formed of at least one cable or a double cable.

10. The elevator according to claim 1 wherein said first and second traction means are formed as a belt.

11. The elevator according to claim 10 wherein said first and second traction means are one of a cogged belt, a ribbed belt and a V-belt.

12. The elevator according to claim 1 wherein said first and second traction means each are a belt, said belts being guided by said first and second drive pulleys, said first deflecting rollers, second deflecting rollers, third deflecting rollers and fourth deflecting rollers, said belts being disposed in contact with said first and second drive pulleys and said first through fourth deflecting rollers only at one side of said belts, and said belts are guided between fixing points to be substantially free of twisting.

13. The elevator according to claim 1 wherein said first and second drives are disposed and fastened in the region of the shaft head at different levels.

14. The elevator according to claim 1 wherein said first and second drives are located and fastened in the region of the shaft head at a same level.

15. The elevator according to claim 1 wherein said first and second drives are each positioned on a respective beam.

16. The elevator according to claim 1 wherein the elevator has shaft doors and said first and second cars have a respective car door, wherein the shaft doors have two sliding elements and the car doors have more than two sliding elements.

17. The elevator according to claim 1 including another first deflecting roller associated with said second drive, wherein said first and second elevator cars are guided by car guide rails in the elevator shaft, wherein said first and second drives drive and said associated first deflecting rollers roller each lie on a respective one side of a connecting line of the car guide rails, and wherein said second drive and said associated another first deflecting roller each lie on an opposite side of the connecting line of the car guide rails.

18. The elevator according to claim 1 including another first deflecting roller associated with said second drive, wherein said first and second elevator cars are guided by car guide rails, wherein said first and second drives and said associated another first deflecting rollers roller each lie on a same side of a connecting line of the car guide rails, and wherein said first deflecting roller associated with said first drive lies on an opposite side of the connecting line of the car guide rails.

19. An elevator with at least two elevator cars which are disposed one above the other in an elevator shaft having a first shaft sidewall and a second shaft sidewall disposed opposite one another in the elevator shaft, which cars are vertically movable, comprising:

a first elevator car of the at least two elevator cars connected to a first counterweight by a first traction means;

a first drive fixed in a region of a head of the elevator shaft and having a first drive pulley for driving said first traction means;

a second elevator car of the at least two elevator cars connected to a second counterweight by a second traction means;

a second drive fixed in the region of the head of the elevator shaft at the second shaft side wall and having a second drive pulley for driving said second traction means;

a first deflecting roller associated with said first drive and being positioned at the second shaft side wall above said first counterweight whereby said first traction means is led from said first counterweight over said first deflecting roller to said first drive pulley and from there to said first elevator car, said first counterweight and the second counterweight being positioned in the same elevator shaft; and at least one of said first and second traction means having opposite ends attached to the elevator shaft at fixing points on a same side of said first and second elevator cars.

* * * * *